US010781672B2

(12) United States Patent
Lazo et al.

(10) Patent No.: US 10,781,672 B2
(45) Date of Patent: Sep. 22, 2020

(54) PROTECTIVE SHROUDS FOR SAND CONTROL SCREEN ASSEMBLIES

(71) Applicant: CHEVRON U.S.A. INC., San Ramon, CA (US)

(72) Inventors: Antonio Lazo, Houston, TX (US); Namhyo Kim, Houston, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 57 days.

(21) Appl. No.: 16/204,889

(22) Filed: Nov. 29, 2018

(65) Prior Publication Data

US 2019/0093458 A1 Mar. 28, 2019

Related U.S. Application Data

(63) Continuation-in-part of application No. 15/353,029, filed on Nov. 16, 2016, and a continuation-in-part of application No. 15/353,416, filed on Nov. 16, 2016, now Pat. No. 10,450,844.

(60) Provisional application No. 62/403,954, filed on Oct. 4, 2016, provisional application No. 62/403,922, filed on Oct. 4, 2016, provisional application No. 62/350,478, filed on Jun. 15, 2016, provisional application No. 62/350,443, filed on Jun. 15, 2016.

(51) Int. Cl.
*E21B 43/08* (2006.01)

(52) U.S. Cl.
CPC ..... *E21B 43/086* (2013.01); *E21B 43/084* (2013.01); *E21B 43/08* (2013.01); *E21B 43/088* (2013.01)

(58) Field of Classification Search
CPC ..... E21B 43/08–086; B21C 37/122
USPC ..... 228/137; 29/896.62
See application file for complete search history.

(56) References Cited

U.S. PATENT DOCUMENTS

| | | | | | |
|---|---|---|---|---|---|
| 246,232 | A | * | 8/1881 | Spencer | F16L 11/16 138/154 |
| 308,800 | A | * | 12/1884 | Ritchie | F16L 11/16 138/154 |
| 975,334 | A | | 8/1910 | Decker et al. | |
| 1,273,236 | A | | 7/1918 | Layne | |
| 1,878,432 | A | | 9/1932 | Whann | |
| 2,233,233 | A | | 2/1941 | Williams | |
| 2,697,953 | A | * | 12/1954 | Chapman | B21D 22/04 72/356 |
| 3,078,818 | A | | 2/1963 | Butler | |
| 3,194,047 | A | * | 7/1965 | Eggert, Jr. | B21D 22/206 72/349 |
| 3,739,134 | A | | 6/1973 | Wade | |
| 4,141,481 | A | | 2/1979 | Van Petten | |

(Continued)

FOREIGN PATENT DOCUMENTS

| | | | |
|---|---|---|---|
| CN | 105257250 | | 1/2016 |
| JP | 2005230885 | A * | 9/2005 |

(Continued)

*Primary Examiner* — Steven A MacDonald
(74) *Attorney, Agent, or Firm* — King & Spalding LLP

(57) ABSTRACT

A sand control screen assembly having a protective shroud or jacket that provides a controlled offset between the shroud and a filter medium. The sand control screen assembly also includes a base pipe having a drainage layer positioned therearound for preventing the flow of particulate material of a predetermined size therethrough and allowing the flow of production fluids therethrough.

18 Claims, 11 Drawing Sheets

(56) References Cited

U.S. PATENT DOCUMENTS 4,251,970 A * 2/1981 Home ..... B21C 37/157 52/674
4,763,830 A 8/1988 Davis
5,339,895 A 8/1994 Arterbury et al.
5,355,956 A 10/1994 Restarick
5,611,399 A * 3/1997 Richard ..... B01D 29/111 166/230
5,673,585 A * 10/1997 Bishop ..... B21D 22/04 72/404
5,957,205 A 9/1999 Bohme et al.
6,530,431 B1 3/2003 Castano-Mears et al.
8,176,634 B2 * 5/2012 Bonner ..... E21B 43/08 29/896.62
8,251,138 B2 8/2012 Bonner et al.
8,701,757 B2 * 4/2014 Greci ..... E21B 43/088 166/227
8,850,706 B2 * 10/2014 Bonner ..... E21B 43/08 29/896.62
9,441,463 B2 9/2016 Cunningham et al.
9,748,699 B1 * 8/2017 Skipor ..... H05K 7/142
2003/0010811 A1 1/2003 Chung
2004/0004110 A1 * 1/2004 Blackburne, Jr. ..... B01D 29/111 228/130
2004/0016539 A1 * 1/2004 Richard ..... E21B 17/1035 166/207
2007/0199973 A1 8/2007 Tueshaus et al.
2008/0289815 A1 11/2008 Moen et al.
2010/0000742 A1 * 1/2010 Bonner ..... E21B 43/08 166/378
2010/0163481 A1 7/2010 McGrenera et al.
2010/0258301 A1 10/2010 Bonner et al.
2011/0105477 A1 5/2011 Hammer
2011/0180258 A1 7/2011 Scott et al.
2011/0265990 A1 11/2011 Augustine et al.
2012/0073801 A1 3/2012 Greci et al.
2012/0138287 A1 * 6/2012 Bonner ..... E21B 43/08 166/227
2014/0360718 A1 * 12/2014 Ma ..... E21B 43/086 166/231
2015/0144330 A1 5/2015 Noblett et al.
2015/0274352 A1 10/2015 Lipp
2015/0375144 A1 12/2015 Greci
2016/0024895 A1 1/2016 Russell et al.
2017/0362921 A1 12/2017 Kim et al.

FOREIGN PATENT DOCUMENTS

JP 2007/126888 5/2007
WO WO 2014/137332 9/2014
WO WO 2017/039840 3/2017

* cited by examiner

PROTECTIVE SHROUDS FOR SAND CONTROL SCREEN ASSEMBLIES

CROSS-REFERENCE TO RELATED APPLICATIONS

This application is a continuation-in-part of U.S. patent application Ser. No. 15/353,029, titled "Protective Shrouds For Sand Control Screen Assemblies" and filed on Nov. 16, 2016, and of U.S. patent application Ser. No. 15/353,416, titled "Drainage Layers For Sand Control Screen Assemblies" and filed on Nov. 16, 2016. U.S. patent application Ser. No. 15/353,029 claims priority under 35 U.S.C. § 119 to U.S. Provisional Patent Application Ser. No. 62/350,443, titled "Protective Shrouds For Sand Control Screen Assemblies" and filed on Jun. 15, 2016, and to U.S. Provisional Patent Application Ser. No. 62/403,922, titled "Protective Shrouds For Sand Control Screen Assemblies" and filed on Oct. 4, 2016. U.S. patent application Ser. No. 15/353,416 claims priority under 35 U.S.C. § 119 to U.S. Provisional Patent Application Ser. No. 62/350,478, titled "Drainage Layers For Sand Control Screen Assemblies" and filed on Jun. 15, 2016, and to U.S. Provisional Patent Application Ser. No. 62/403,954, titled "Drainage Layers For Sand Control Screen Assemblies" and filed on Oct. 4, 2016. The entire contents of the above applications are hereby incorporated herein by reference.

TECHNICAL FIELD

The present application relates generally to structures adapted for filtering particulates from a flowing fluid in a wellbore that traverse a subterranean hydrocarbon bearing formation, and in particular, to protective jackets, or shrouds, for sand control screen assemblies.

BACKGROUND

Sand exclusion screen assemblies are employed in wellbores during the production of hydrocarbon fluids from subterranean formations. Conventional sand screen assemblies include a perforated base pipe, a drainage layer, a filter medium, and a protective jacket or shroud. Such screen assemblies are designed to filter out particles, such as formation sand or placed gravel/proppant, while facilitating the passage of hydrocarbon fluids into the wellbore. One drawback in the deployment of such screen assemblies is the erosion of the filter medium by particle impingement contained in the fluids that pass the screen assemblies. The presence of particulate in the flow stream, coupled with the current designs and manufacturing methods of the screen assemblies, can cause erosion. For instance, current designs and manufacturing methods minimize the space, or offset, between the sand screen components for a number of reasons, which can increase erosion of the filter medium. For example, the offset between conventional shrouds and the filter medium is not controlled and the shrouds are susceptible to deformation and/or radial movement, which can cause the shroud to interface with the filter medium at various locations away from the welds at the ends of the base pipe. Since conventional shrouds may have perforated holes, these holes cause a flow concentration that localizes and increases the erosion of the filter medium resulting from an inadequate amount of flow dispersion due to the interface between the shroud and the filter medium. When the filter medium becomes eroded, then particles are produced from the well, which is highly undesirable. Production of these particles can cause excessive erosion of production tubulars, downhole equipment and surface equipment, and lead to high maintenance costs and undesirable downtime of wells.

Accordingly, a need has arisen for a sand control screen assembly that is capable of filtering fines out of a production stream from a subterranean hydrocarbon bearing formation and that does not readily suffer from erosion.

SUMMARY

The present application is generally related to protective jackets or shrouds for sand control screen assemblies for filtering particulates from a flowing fluid in a wellbore that traverses a subterranean hydrocarbon bearing formation.

In an example embodiment, a sand control screen assembly includes a filter medium for particle control and/or particle filtration, a protective shroud or jacket disposed about the filter medium, and dimples extending from the jacket's inner surface towards the filter medium. The dimples provide substantially uniform radial spacing relative to the jacket's inner surface. The dimples have a rounded head with a large radius of curvature that interfaces with the filter medium. Generally, the sand control screen assembly also includes a base pipe and a drainage layer. The drainage layer is positioned about the base pipe, and the filter medium is positioned about the drainage layer. In certain instances where a drainage layer is not utilized, the filter medium is positioned about the base pipe.

In another example embodiment, a method of manufacturing a jacket for a sand control screen assembly includes (a) providing a single sheet of metal, (b) forming at least one dimple on the metal sheet adjacent to a junction where the metal sheet is assembled to form the jacket, and (c) assembling the metal sheet to form the jacket, wherein upon assembly, the at least one dimple faces an interior of the jacket. Generally, the sand control screen assembly also includes a filter medium. The jacket is positioned about the filter medium, and the dimple(s) provide a substantially uniform radial spacing between the filter medium and the jacket.

These and other aspects, objects, features, and embodiments will be apparent from the following description and the appended claims.

DETAILED DESCRIPTION

Figure 1:
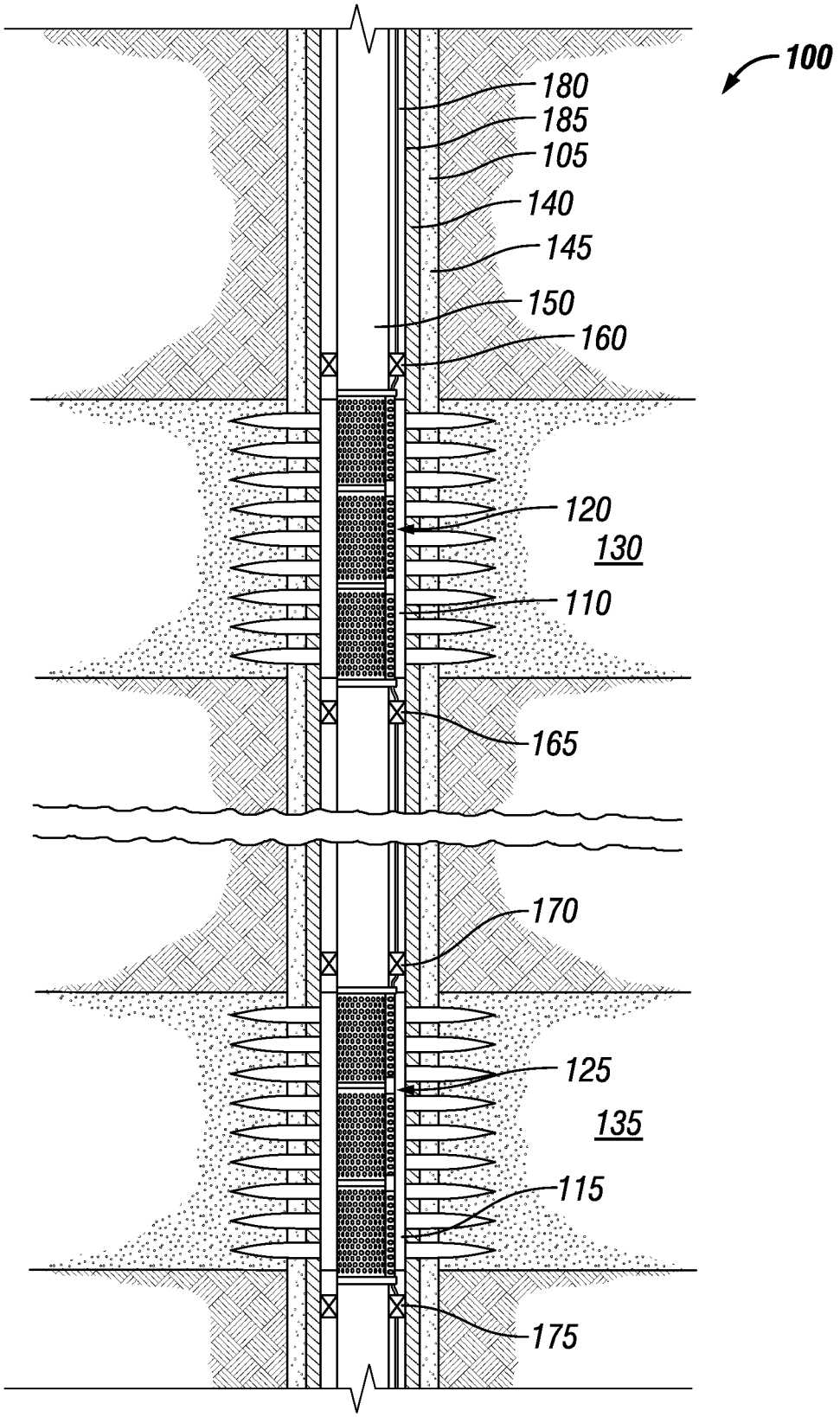
FIG. 1 is a schematic illustration of a wellbore environment including a pair of sand control screen assemblies, according to an embodiment of the present invention.
Figure 2A:
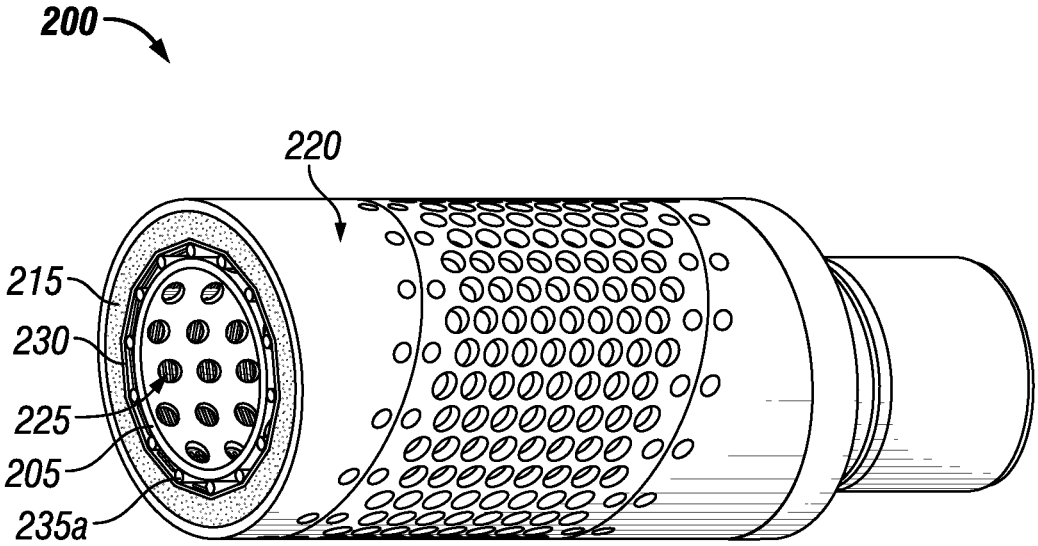
FIG. 2A is a top perspective view of a sand control screen assembly, according to an embodiment of the present invention.
Figure 2B:
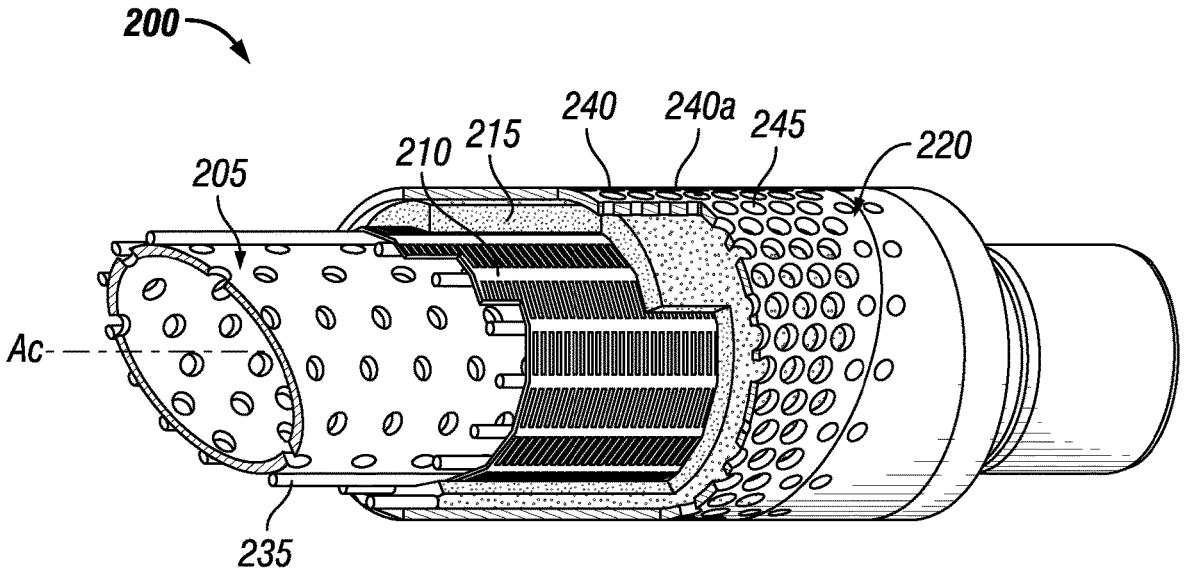
FIG. 2B is a partial cut away view of the sand control screen assembly of FIG. 2A, according to an embodiment of the present invention.
Figure 2D:
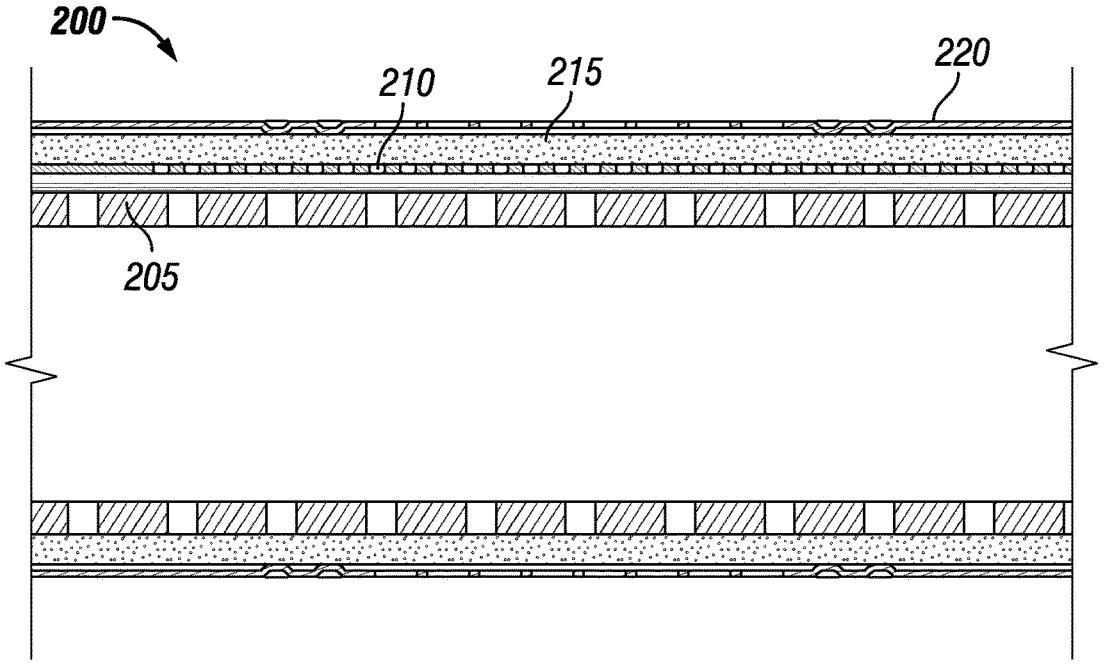
FIG. 2D is a side cross-sectional view of the sand control screen assembly of FIG. 2A, according to an embodiment of the present invention.
Figure 2C:
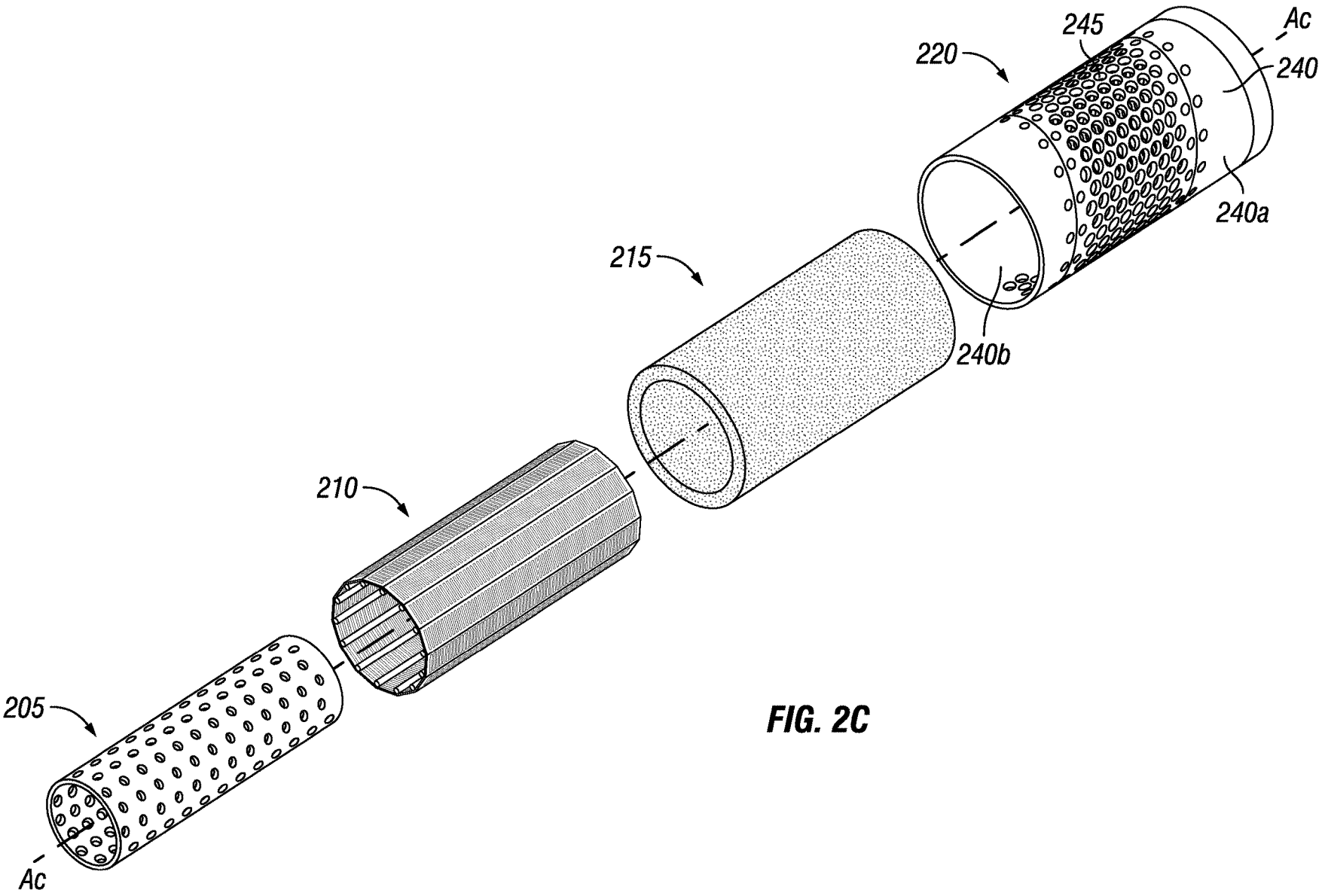
FIG. 2C is an exploded view of the sand control screen assembly of FIG. 2A, according to an embodiment of the present invention.

The present application provides sand control screen assemblies that are more resistant to erosion than conventional sand control screen assemblies. By limiting erosion loss, it is not required to reduce the rate of oil and gas production, which is common in instances of sand screen erosion.

The invention may be better understood by reading the following description of non-limitative, exemplary embodiments with reference to the attached drawings, wherein like parts of each of the figures are identified by the same reference characters. In the following description of the representative embodiments of the invention, directional terms, such as "above", "below", "top", "bottom", "inner", "outer", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore towards the bottom of well.

Referring to FIG. 1, illustrated is a wellbore system 100 that may employ the principles of the present disclosure, according to one or more embodiments of the disclosure. As depicted, the wellbore system 100 includes a wellbore 105 having production intervals 110, 115, having sand control screen assemblies 120, 125, respectively, positioned therein. The wellbore 105 extends through various formations 130, 135 in the earth strata. A casing 140 is supported within wellbore 105 by cement 145. A production or completion string 150 includes various tools, such as sand control screen assembly 120 that is positioned within production interval 110 between packers 160, 165. In addition, the production or completion string 150 includes a sand control screen assembly 125 that is positioned within production interval 115 between packers 170, 175. The sand control screen assemblies 120, 125 serve the primary functions of filtering particulate matter out of the production fluid stream and may also include flow control capabilities or other additional functionality. One or more control lines 180 may extend from a ground surface within annulus 185 and pass through sand control screen assemblies 120, 125 to provide instructions, carry power, signals and data, and transport operating fluid, such as hydraulic fluid, to sensors, actuators and the like associated with sand control screen assemblies 120, 125 and other tools or components positioned downhole. Sensors (not shown) operably associated with production or completion string 150 may be used to provide valuable information to the operator via control line 180 during the production phase of the well, such as fluid temperature, pressure, velocity, constituent composition and the like, such that the operator can enhance the production operations.

Even though FIG. 1 depicts sand control screen assemblies 120, 125 in a cased hole environment, one skilled in the art will recognize that the sand control screen assemblies of the present invention are equally well suited for use in open hole environments. Also, even though FIG. 1 depicts a vertical completion, one skilled in the art will recognize that the sand control screen assemblies of the present invention are equally well suited for use in well having other directional configurations including horizontal wells, deviated wells, multilateral wells, and the like.

FIGS. 2A-2D illustrate an exemplary embodiment of a sand control screen assembly 200 for use in wellbore 105 (FIG. 1). The sand control screen assembly 200 may replace one or more of the screen assemblies 120, 125 described in FIG. 1 and may otherwise be used in the exemplary wellbore system 100 depicted therein.

The screen assembly 200 generally includes a perforated base pipe 205, a drainage layer 210, a filter medium 215, and a single protective jacket or shroud 220. Generally, during hydrocarbon production, fluid from the subterranean formation flows in a direction from the formation, through the shroud 220, and towards a central axis Ac of the base pipe 205. The base pipe 205 provides structural support to the assembly 200, and also provides flow communication via openings 225 with the production or completion string 150 (FIG. 1) in the wellbore 105. The drainage layer 210 occasionally is a slotted screen and includes a plurality of ribs 235 that are substantially symmetrically disposed or positioned about the central axis Ac of the base pipe 205. In certain embodiments, the slotted screen is made up of wrapped wires. The drainage layer 210 is placed around the surface of the base pipe 205 and typically distributes inflow to the base pipe 205. In certain embodiments, the drainage layer 210, composed of the slotted screen and the plurality of ribs 235, can be replaced by other porous structures such as metal meshes. The filter medium 215 that surrounds the drainage layer 210 is utilized for particle control and/or particle filtration of a predetermined size. The filter medium 215 is generally woven, wire-wrapped, or a slotted liner. The shroud 220 surrounds the filter medium 215 and provides protection to the assembly 200 during installation. In certain exemplary embodiments, the shroud 220 is a perforated jacket. Generally, not more than one shroud is utilized in the screen assemblies of the present invention. The shroud 220 is a generally cylindrical-shaped tube 240 having one or more openings 245 that extend from an outer wall 240*a* of the tube 240 to an inner wall 240*b* of the tube 240. Fluid from the subterranean formation generally flows in a direction from the outer wall 240*a* towards the inner wall 240*b* through openings 245. An offset is provided between the shroud 220 and the filter medium 215, as described further with the exemplary embodiments below.

FIGS. 3A-3D illustrate an exemplary embodiment of a shroud 300 for a sand control screen assembly for use in a wellbore. Along with the other shrouds described in the present application, the shroud 300 may replace the shroud 220 of the sand control screen assembly 200 described in FIGS. 2A-D and may otherwise be used in the exemplary wellbore system 100 (FIG. 1) depicted therein.

The shroud 300 is a generally cylindrical-shaped tube 340 that is formed by rolling a metal sheet and welding helically or spirally at a junction J1 such that a cylindrical structure is formed. Generally, the tube 340 is formed without the use of any interlocking components or wires, other than those required for welding the metal at junction J1. The shroud 300 includes one or more openings 345 that extend from an outer wall 340*a* of the tube 340 to an inner wall 340*b* of the tube 340, whereby fluid can pass through the openings 345. In certain exemplary embodiments, the tube 340 has a wall thickness TI (distance between the outer wall 340*a* and the inner wall 340*b*) in the range of from about 0.06 inch to about 0.125 inch.

Figure 3A:
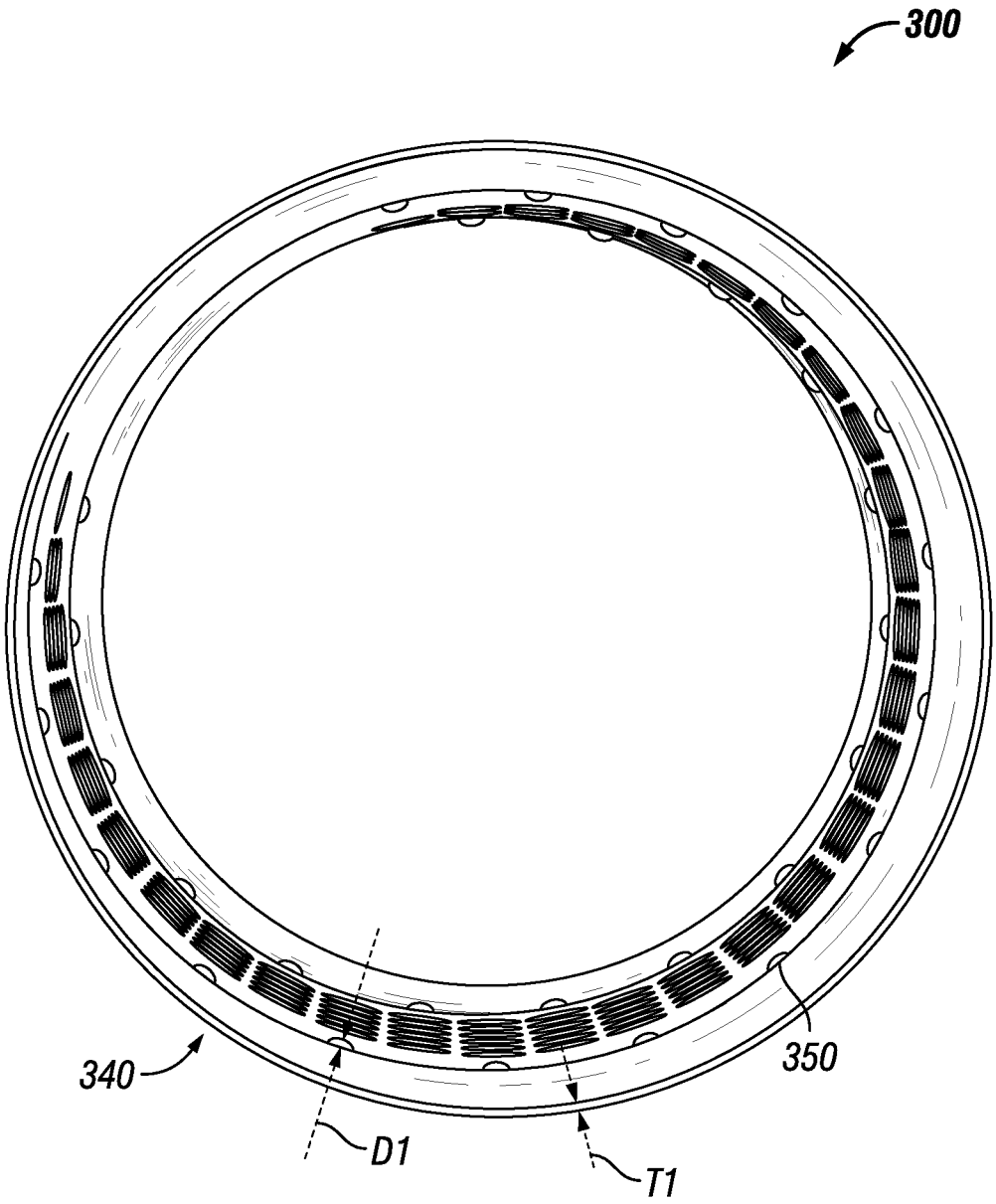
FIG. 3A is a side view of a shroud for a sand control screen assembly, showing the interior of the shroud, according to an embodiment of the present invention.
Figure 3B:
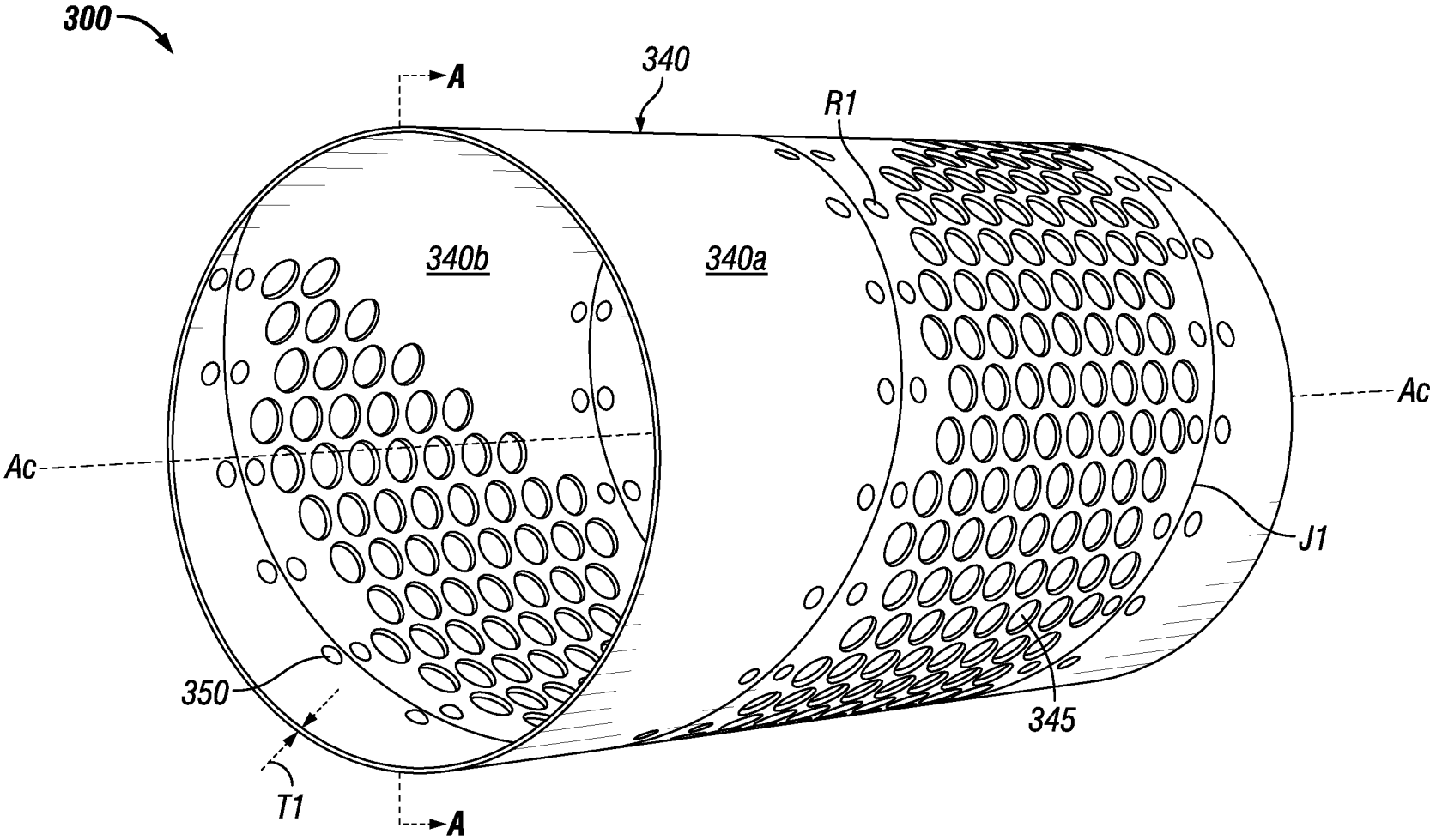
FIG. 3B is a perspective view of the shroud of FIG. 3A, according to an embodiment of the present invention.
Figure 3C:
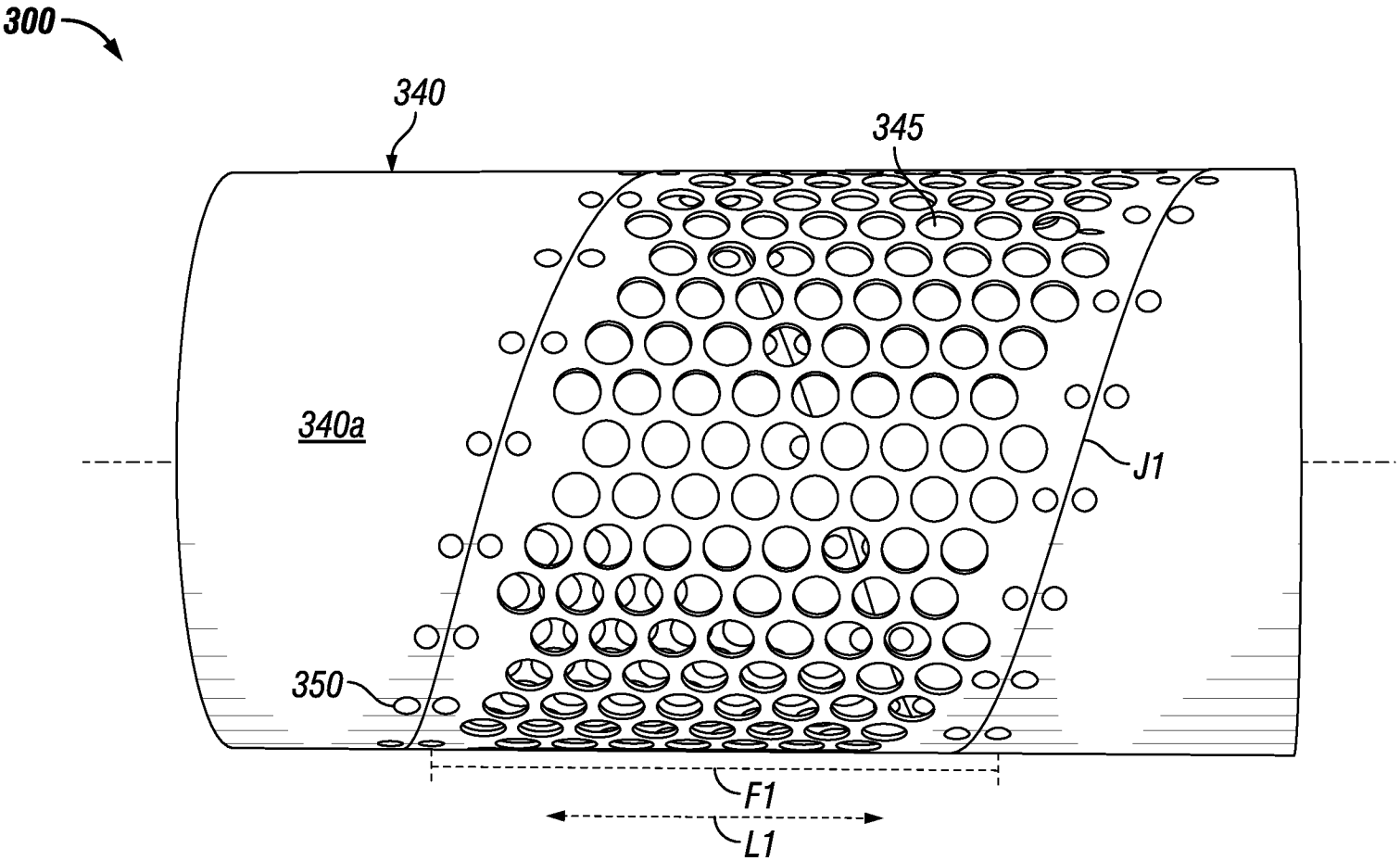
FIG. 3C is a side view of the shroud of FIG. 3A, according to an embodiment of the present invention.
Figure 3D:
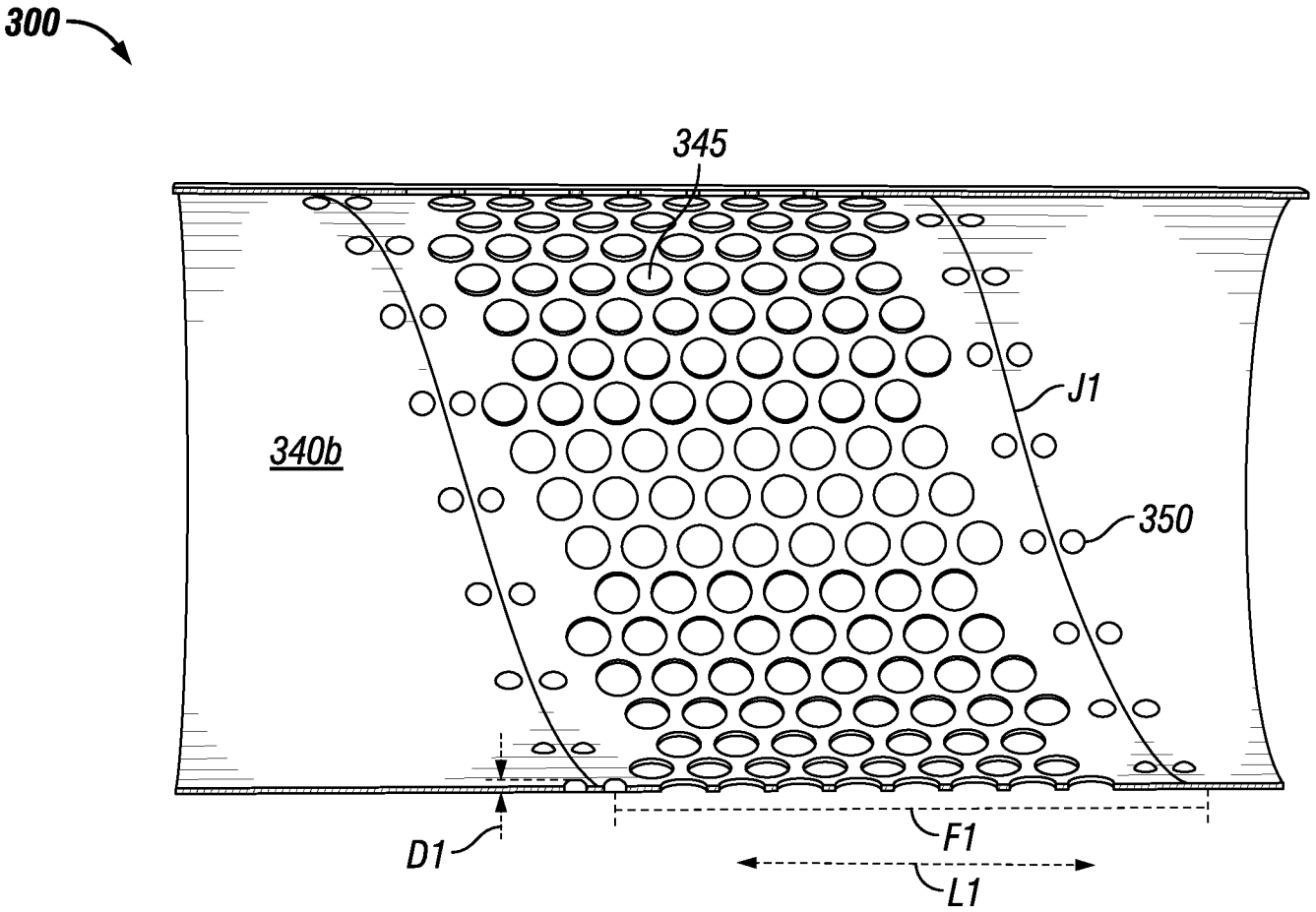
FIG. 3D is a side cross-sectional view of the shroud of FIG. 3A, taken along section A-A, according to an embodiment of the present invention.

In certain exemplary embodiments, the shroud 300 includes an offset D1 provided by dimples 350. The dimples 350 are formed adjacent to or near the junction J1 where the metal sheet is welded to form tube 340 of the shroud 300. The dimples 350 may be formed in the metal sheet forming the tube 340 in any suitable manner known to one having ordinary skill in the art, such as stamping. In certain alternative embodiments, the dimples 350 are formed at a position away from the junction J1. The dimples 350 are present on either side of the junction J1 so as to visually form a double helical row of dimples along the tube 340. In certain exemplary embodiments, the dimples 350 line up in pairs when the tube 340 is assembled, as shown in FIGS. 3B-3C. In certain other embodiments, the protrusions 350 may be offset from one another when the tube 340 is assembled.

The dimples 350 protrude radially inwards towards a central axis Ac, and provides offset D1 between the shroud 300 and a filter medium (not shown). The offset D1 can be in the range of from about 0.05 to about 0.25 inch. In certain exemplary embodiments, the offset D1 is in the range of from about 0.1 to about 0.25 inch. In certain exemplary embodiments, the offset D1 is in the range of from about 0.2 to about 0.25 inch. In exemplary embodiments, the dimples 350 are rounded or dome-shaped with a large radius of curvature so as not to damage internal components, such as a filter medium. Once the tube 340 is constructed, the controlled offset D1 allows for dispersion of fluid flow and therefore a decay of velocities approaching the filter medium. The lower approach velocity results in a lower erosion rate over conventional shrouds utilized. In addition, in certain embodiments, the offset D1 may also provide some structural support to the shroud 300.

In certain embodiments, the dimples 350 are present with a frequency F1 in the range of from about 4 inches to about 8 inches in a longitudinal direction L1. In certain exemplary embodiments, the dimples 350 are present with a frequency F1 of about every 6 inches in the longitudinal direction L1. In certain embodiments, the openings 345 are present in a range of from about 30 to about 50 holes between junction J1 weld joints. In certain exemplary embodiments, about 38 openings 345 are present between junction J1 weld joints.

The dimples 350 are generally hollow within. In other words, a recess or indentation R1 is present in the outer wall 340*a* of the tube 340, each recess R1 corresponding to a dimple 350 protruding from the inner wall 340*b*. In certain exemplary embodiments, no other channels, protrusions, extensions, tongues, projections, ribs, rings, and the like are present in the shroud 300 other than the openings 345, the dimples 350, and weld joints at junction J1. In some embodiments, clamps and/or channels (not shown) manufactured into the shroud may be present to accommodate control lines.

Figure 4A:
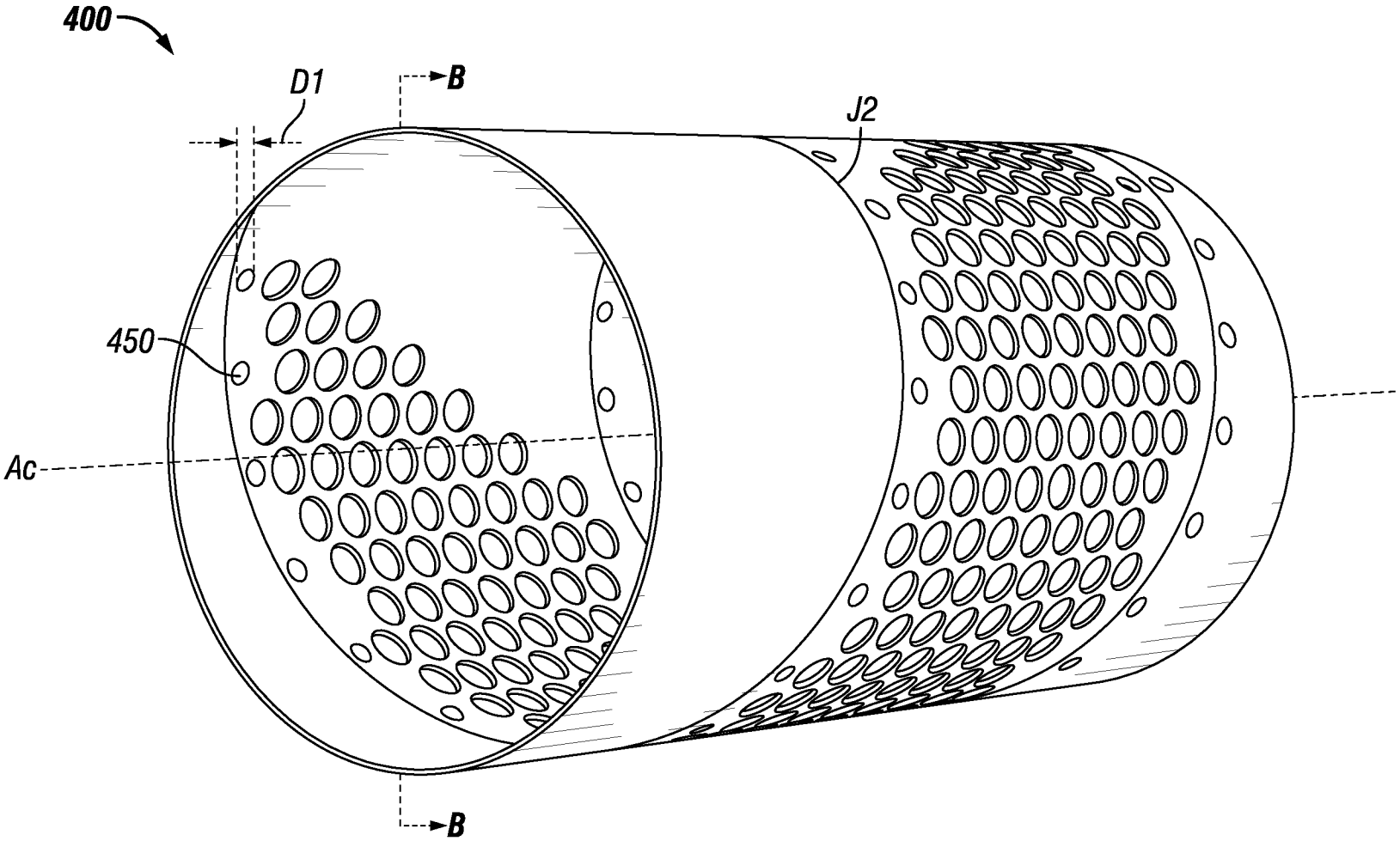
FIG. 4A is a perspective view of another shroud for a sand control screen assembly, according to an embodiment of the present invention.
Figure 4B:
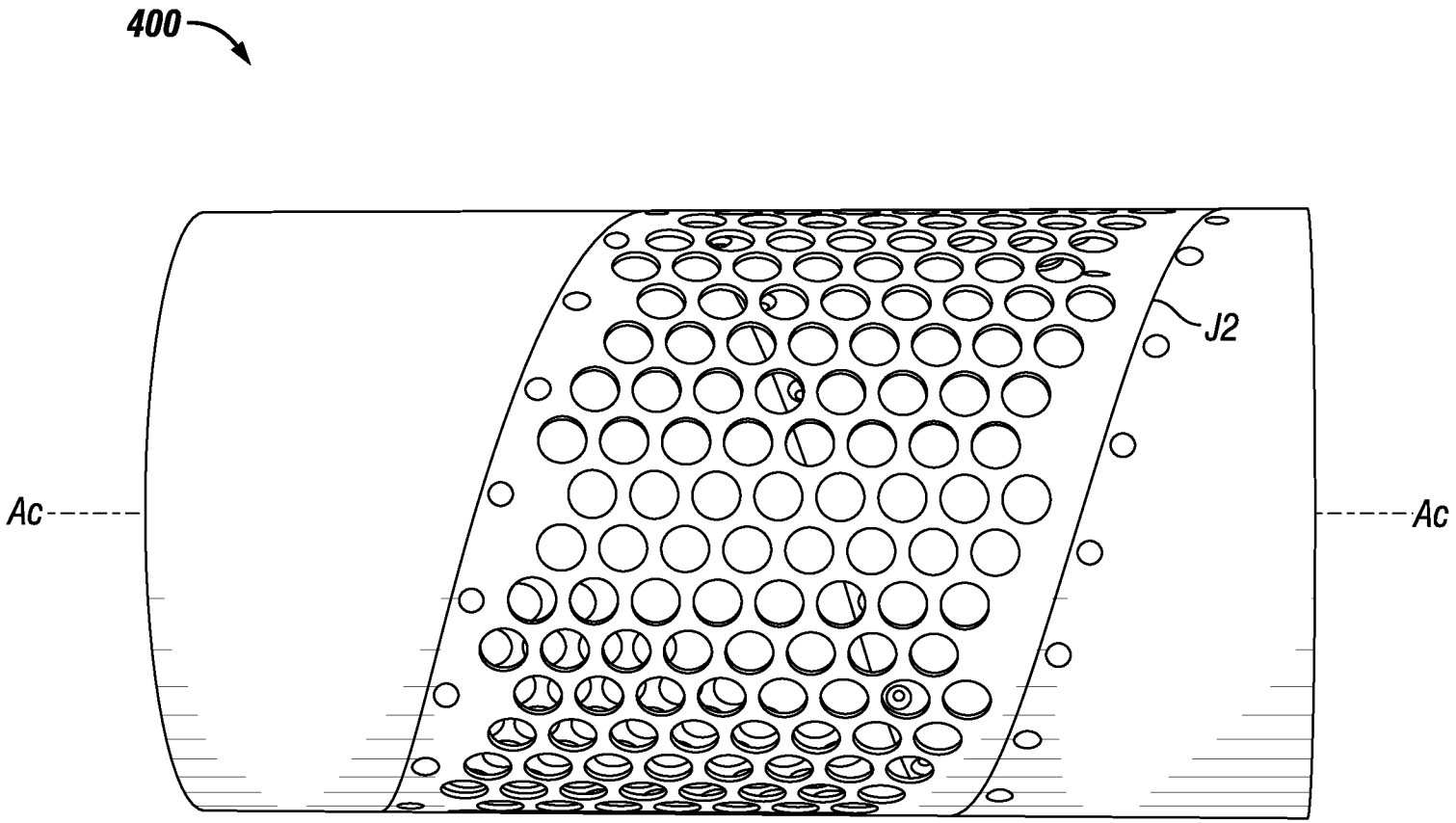
FIG. 4B is a side view of the shroud of FIG. 4A, according to an embodiment of the present invention.
Figure 4C:
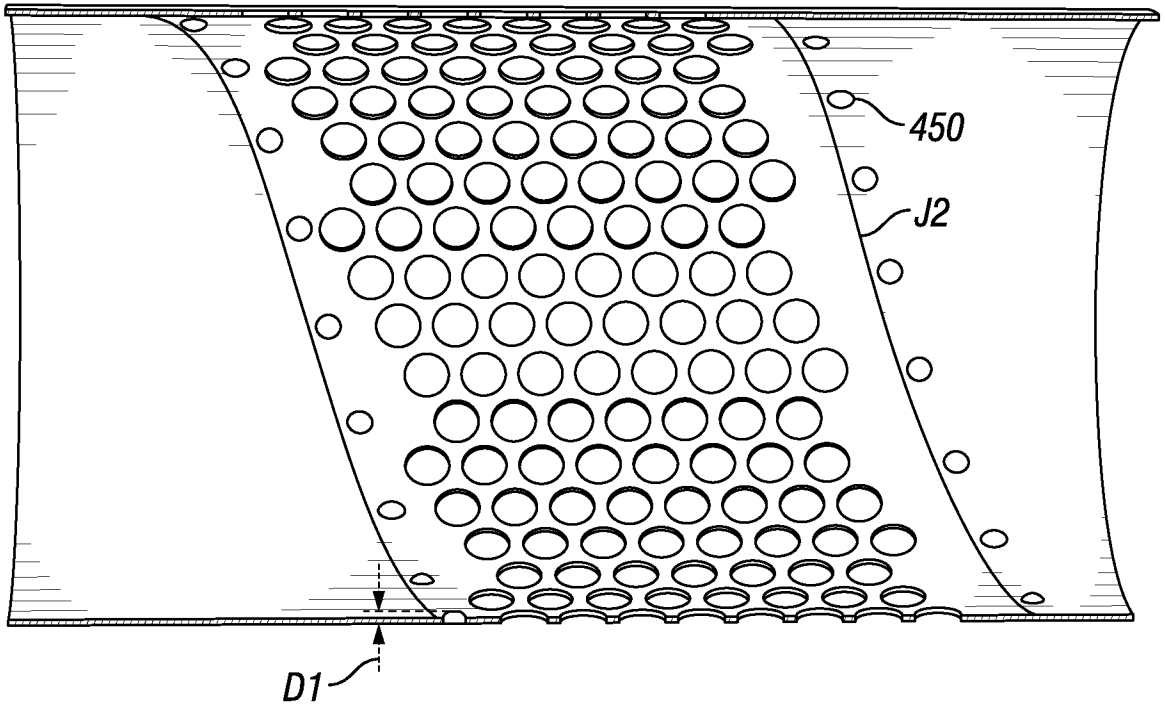
FIG. 4C is a side cross-sectional view of the shroud of FIG. 4A, taken along section B-B, according to an embodiment of the present invention.

FIGS. 4A-4C illustrate an exemplary embodiment of a shroud 400 for a sand control screen assembly for use in a wellbore. Along with the other shrouds described in the present application, the shroud 400 may replace the shroud 220 of the sand control screen assembly 200 described in FIGS. 2A-D and may otherwise be used in the exemplary wellbore system 100 (FIG. 1) depicted therein. The shroud 400 is the same as that described above with regards to shroud 300, except as specifically stated below. For the sake of brevity, the similarities will not be repeated hereinbelow.

Referring to FIGS. 4A-4C, the shroud 400 includes offset D1 provided by dimples 450. The dimples 450 are formed adjacent to or near a junction J2 where the metal sheet is welded to form a tube. In certain alternative embodiments, the dimples 450 are formed at a position away from the junction J2. The dimples 450 are present on a single side of the junction J2 so as to visually form a single helical row of dimples along the tube.

Methods of manufacturing a jacket or shroud 220, 300, 400 for a sand control screen assembly include providing a single sheet of metal, forming a plurality of openings that extend through the sheet of metal from one side to the other, forming a plurality of dimples on the metal sheet adjacent to a junction where the metal sheet is assembled to form the shroud, and helically or spirally winding the metal sheet to form a tube and welding the metal sheet to form the shroud, wherein upon assembly, the dimples face an interior of the shroud. In certain exemplary embodiments, the openings are punched at the same time as the dimples are stamped. In other embodiments, the openings are punched prior to the dimples being stamped. In certain exemplary embodiments, the sheet of metal prior to winding is 6 inches wide, 100 feet long, and has a thickness in the range of from about 0.06 inch to about 0.125 inch.

Although embodiments described herein are made with reference to example embodiments, it should be appreciated by those skilled in the art that various modifications are well within the scope and spirit of this disclosure. In addition, while the present figures illustrate rounded or dome-shaped dimples 350, 450 having a circular profile, one having ordinary skill in the art will recognize that in alternative embodiments, these dimples can have any profile shape configuration, such as triangular, elliptical, oval, square, rectangular, quatrefoil, curvilinear triangular, trapezoidal, pentagon, hexagon, other polygons, asymmetrical, and the like, as long as the dimples have a head with a large radius of curvature. One having ordinary skill in the art will also recognize that the dimples 350, 450 can vary in size, number, frequency, arrangement, and the like, from application to application. Also, the dimples 350, 450 can be formed by any means known to one having ordinary skill in the art, including, but not limited to, extrusion, piercing, punching, dimpling, dimple forming, forming process, roll forming, and stamping. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A sand control screen assembly, comprising:

a filter medium for particle control and/or particle filtration; and a perforated jacket disposed about the filter medium, wherein the perforated jacket is manufactured from a single sheet of metal having a left side and a right side, wherein the single sheet of metal is helically wrapped around itself to form a tubular shape, wherein the jacket comprises a plurality of stamped protrusions extending from an inner surface of the jacket, wherein the plurality of stamped protrusions have a rounded head with a radius of curvature that contacts an outer surface of the filter medium, wherein the plurality of stamped protrusions are arranged proximate to the left side of the single sheet of metal before being wrapped into the tubular shape, wherein the plurality of stamped protrusions maintain their shape when contacting the filter medium, and wherein the plurality of stamped protrusions are closed so that fluid does not pass through the plurality of stamped protrusions.

2. The sand control screen assembly of claim 1, wherein the plurality of stamped protrusions provide substantially uniform radial spacing relative to the jacket's inner surface.

3. The sand control screen assembly of claim 2, wherein the radial spacing is in a range of from about 0.05 to about 0.25 inch.

4. The sand control screen assembly of claim 1, wherein the plurality of stamped protrusions are further arranged proximate to the right side of the single sheet of metal before being wrapped into the tubular shape.

5. The sand control screen assembly of claim 1, wherein the plurality of stamped protrusions are present in a frequency of about six inches proximate to the left side of the single sheet of metal.

6. The sand control screen assembly of claim 1, wherein an outer surface of the jacket comprises recesses in positions corresponding to the plurality of stamped protrusions of the inner surface.

7. The sand control screen assembly of claim 1, wherein the plurality of stamped protrusions have a profile shape configuration selected from the group consisting of circular, triangular, elliptical, oval, square, rectangular, quatrefoil, curvilinear triangular, trapezoidal, pentagon, hexagon, other polygons, and asymmetrical.

8. The sand control screen assembly of claim 1, wherein the plurality of stamped protrusions are dimples.

9. The sand control screen assembly of claim 8, wherein the dimples are dome-shaped.

10. The sand control screen assembly of claim 1, wherein the jacket has no other features aside from perforations in the single sheet of metal, the plurality of stamped protrusions, and weld joints at junctions along where the left side of the single sheet of metal abuts against the right side of the single sheet of metal when the single sheet of metal is helically wrapped around itself to form the tubular shape.

11. The sand control screen assembly of claim 1, further comprising a base pipe, wherein the filter medium is disposed about the base pipe.

12. The sand control screen assembly of claim 1, further comprising a base pipe and a drainage layer, wherein the filter medium is disposed about the drainage layer, and wherein the drainage layer is disposed about the base pipe.

13. The sand control screen assembly of claim 1, wherein the plurality of stamped protrusions form pairs around a junction where the left side and the right side of the single sheet of metal abut against each other.

14. A method of manufacturing a jacket for a sand control screen assembly, the method comprising:

providing a single sheet of metal having a plurality of perforations therethrough, wherein the single sheet of metal has a left side and a right side;

stamping a plurality of protrusions proximate to the left side of the single sheet of metal, wherein each of the plurality of protrusions has a rounded head with a radius of curvature, and wherein the plurality of stamped protrusions are closed so that fluid does not pass through the plurality of stamped protrusions; and assembling the single sheet of metal to form the jacket by helically wrapping the single sheet of metal around itself to form a tubular shape, wherein upon assembly each of the plurality of protrusions faces an interior of the jacket, wherein each of the plurality of protrusions is configured to maintain a substantially constant distance of separation between a remainder of the perforated jacket and a filter medium disposed inside the jacket.

15. The method of claim 14, wherein the plurality of protrusions comprises dimples extending from the inner surface of the jacket.

16. The method of claim 14, wherein the substantially constant distance of separation maintained by the plurality of protrusions is in a range of from about 0.05 to about 0.25 inch.

17. The method of claim 14, wherein the protrusions are stamped dimples having a head having a radius of curvature.

18. The method of claim 14, wherein the plurality of protrusions are further stamped proximate to the right side of the single sheet of metal.

* * * * *